US006616266B2

(12) United States Patent
Neal et al.

(10) Patent No.: US 6,616,266 B2
(45) Date of Patent: Sep. 9, 2003

(54) METHOD FOR INCREASING WASTE INK COLLECTION CAPACITY IN AN INK JET PRINTER BY UTILIZING MULTIPLE INK SPIT AREAS ALONG THE CARRIER PATH

(75) Inventors: Mark Aaron Neal, Lexington, KY (US); Charles Jarratt Simpson, Lexington, KY (US); Gregory Paul Washnock, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/918,333

(22) Filed: Jul. 30, 2001

(65) Prior Publication Data

US 2003/0020782 A1 Jan. 30, 2003

(51) Int. Cl.[7] ..... B41J 2/165
(52) U.S. Cl. ..... 347/35; 347/23; 347/36
(58) Field of Search ..... 347/35, 29, 30, 347/33, 32, 23, 100, 36

(56) References Cited

U.S. PATENT DOCUMENTS

| | | | | | |
|---|---|---|---|---|---|
| 5,517,221 | A | | 5/1996 | Nguyen | 347/31 |
| 5,563,639 | A | | 10/1996 | Cameron et al. | 347/34 |
| 5,617,125 | A | | 4/1997 | Chew | 347/36 |
| 5,659,342 | A | | 8/1997 | Lund et al. | 347/35 |
| 5,706,038 | A | * | 1/1998 | Jackson et al. | 347/31 |
| 5,719,603 | A | | 2/1998 | Nguyen | 347/31 |
| 5,742,303 | A | | 4/1998 | Taylor et al. | 347/36 |
| 5,757,395 | A | | 5/1998 | Chew et al. | 347/24 |
| 5,774,142 | A | | 6/1998 | Nguyen et al. | 347/35 |
| 5,847,727 | A | | 12/1998 | VanLiew et al. | 347/33 |
| 5,886,714 | A | | 3/1999 | Burney et al. | 347/33 |
| 5,896,143 | A | * | 4/1999 | Matsui et al. | 347/24 |
| 5,907,336 | A | * | 5/1999 | Hayakawa | 347/29 |
| 5,980,018 | A | | 11/1999 | Taylor et al. | 347/31 |
| 5,997,128 | A | | 12/1999 | Lou et al. | 347/33 |
| 6,042,216 | A | | 3/2000 | Garcia et al. | 347/29 |
| 6,050,671 | A | | 4/2000 | Rotering | 347/35 |
| 6,082,848 | A | | 7/2000 | Taylor | 347/35 |
| 6,102,518 | A | | 8/2000 | Taylor | 347/29 |
| 6,135,585 | A | | 10/2000 | Johnson et al. | 347/32 |
| 6,168,258 | B1 | | 1/2001 | Lou et al. | 347/33 |
| 6,345,878 | B1 | * | 2/2002 | Kanaya | 347/23 |

* cited by examiner

*Primary Examiner*—Shih-Wen Hsieh
(74) *Attorney, Agent, or Firm*—Taylor & Aust, P.C.

(57) ABSTRACT

A method for increasing the waste ink storage capacity in an ink jet printer includes the steps of providing a printer frame including a first frame portion and a second frame portion; providing a platen extending between the first frame portion and the second frame portion; providing a maintenance station coupled to the first frame portion; providing a printhead carrier for carrying a first printhead and a second printhead, and adapted for reciprocating movement along a carrier path, the carrier path extending over the first frame portion and the platen; defining a first ink spit area located at the maintenance station; defining a second ink spit area located at the platen; and selectively controlling an operation of the first printhead during spitting operations to eject a first ink in the first ink spit area and selectively controlling an operation of the second printhead during spitting operations to eject a second ink in the second ink spit area.

31 Claims, 2 Drawing Sheets

METHOD FOR INCREASING WASTE INK COLLECTION CAPACITY IN AN INK JET PRINTER BY UTILIZING MULTIPLE INK SPIT AREAS ALONG THE CARRIER PATH

BACKGROUND OF THE INVENTION

1. Field of the Invention

The present invention relates to an ink jet printer, and, more particularly, to a method for increasing the waste ink storage capacity in an ink jet printer by utilizing multiple ink spit areas along the carrier path.

2. Description of the Related Art

A typical ink jet printer includes a reciprocating carriage, also known as a carrier, carrying at least one ink jet printhead. The printhead includes a nozzle plate having a plurality of ink jet nozzles. Associated with each nozzle is an actuator, such as an electric heater or a piezoelectric device, that when electrically energized causes ink to be ejected from the respective ink jet nozzle. As a sheet of print media is transported in an indexed manner under the printhead, the printhead is scanned in a reciprocating manner across the width of an image area on the sheet of print media. At least a portion of the carrier scan path of the reciprocating printhead defines a print zone. A platen is provided opposite to the printhead for contacting the non-printed side of the print media and, in part, defines the distance between the printhead and the sheet of print media. The actuators associated with the plurality of ink jet nozzles are selectively energized to form an image on the sheet of print media in the image area.

Ink jet printers require maintenance operations to keep the nozzles of the print cartridge operating properly. A maintenance station for performing the maintenance operations typically include at least one printhead wiper, and one cup-shaped printhead cap for each printhead. Such maintenance operations typically include the steps of wiping the nozzle area of the print cartridge, firing the nozzles at prescribed intervals to purge the nozzles (spitting), and capping the cartridge during idle periods to prevent the jetted ink which remains on the nozzle plate from drying and clogging one or more of the nozzles of the nozzle plate.

Briefly, a wiping sequence commences with the printhead over the media feed path and the top of the wiper below the printhead scan path. The wiper is raised until it extends into the path of the printhead surface containing the nozzles, and the printhead is moved to engage the wiper. Thus, accumulated ink and other foreign matter are wiped from the printhead as the printhead moves past the wiper. Typically, the spitting operation occurs at a location in the maintenance station, such as a waste ink spittoon provided on a maintenance sled. During the capping operation, the printhead is moved over the printhead cap and the cap is raised into contact with the printhead in an attempt to form an air tight seal around the region in which the nozzles are located.

During the period that the printhead has been capped, a limited amount of evaporation occurs around the printhead. This evaporation raises the humidity levels inside the cap, and eventually, the evaporation subsides. In order to prepare the printhead after a dormant period, a wiping and spitting operation is performed prior to actual printing. Also, a spitting operation is invoked if during printing a printhead nozzle has remained unfired for a predetermined period of time. In addition, after the printhead has been in use for a predetermined period of time, the wiping and spitting sequence of operations may be performed.

Over a period of time, as a result of the spitting operation the solids in the waste ink accumulate in the maintenance station. Such solids are present, for example, in pigment based monochrome inks. The resulting waste ink buildup can affect the operation of the maintenance assembly. Also, if the waste ink accumulates to a mound height that can contact the printhead, then the printhead can become contaminated by contact with the accumulated waste ink. The vertical growth of the monochrome waste ink accumulation is a function of the spit maintenance duty cycle, i.e., for a given number of monochrome printhead ink spit maintenance cycles, smaller duty cycles tend to build vertical mounds of waste ink faster than longer duty cycles. Many color inks are dye based, and therefore do not include the solids that contribute to vertical growth waste ink buildup.

One previous attempt to accommodate the waste ink ejected during a spitting operation that reduces the waste ink accumulation at the maintenance station is to perform a portion of the spitting operations on-page on a printed sheet at locations where the ejected ink would not adversely affect the print quality of the printed sheet. Such an approach, however, requires a relatively complicated control algorithm and requires exact placement of the ejected ink so as to avoid the appearance of printing imperfections on the printed sheet.

What is needed in the art is an effective method for increasing the waste ink collection capacity of an ink jet printer that does not require placement of ink droplets on a printed page or the inclusion of additional complicated maintenance hardware.

SUMMARY OF THE INVENTION

The present invention provides an effective method for increasing the waste ink collection capacity of an ink jet printer.

The invention provides, in one form thereof, a method including the steps of providing a printer frame including a first frame portion and a second frame portion; providing a platen extending between the first frame portion and the second frame portion; providing a maintenance station coupled to the first frame portion; providing a printhead carrier for carrying a first printhead and a second printhead, and adapted for reciprocating movement along a carrier path, the carrier path extending over the first frame portion and the platen; defining a first ink spit area located at the maintenance station; defining a second ink spit area located at the platen; and selectively controlling an operation of the first printhead during spitting operations to eject a first ink in the first ink spit area and selectively controlling an operation of the second printhead during spitting operations to eject a second ink in the second ink spit area.

In another form, the invention provides a method including the steps of defining a first ink spit area located outside a print zone of the printer; defining a second ink spit area located in the print zone of the printer; defining a third ink spit area located outside the print zone, the print zone being located between the first ink spit area and the third ink spit area; and selectively controlling an operation of a selected one of a plurality of printheads during spitting operations to eject ink in a selected one of the first ink spit area, the second ink spit area and the third ink spit area.

In still another form thereof, the invention provides a method including the steps of providing a printer frame including a first frame portion and a second frame portion; providing a platen extending between the first frame portion and the second frame portion; providing a maintenance station coupled to the first frame portion; providing a printhead carrier for carrying a printhead, and adapted for reciprocating movement along a carrier path, the carrier path extending over the first frame portion, the platen and the second frame portion; defining an ink spit area located at one of the platen and the second frame portion; and selectively controlling an operation of the printhead during spitting operations to eject a pigment based ink in said ink spit area.

An advantage of the present invention is that the effective waste ink collection capacity of an ink jet printer is increased without the inclusion of additional complex maintenance hardware.

Another advantage of the present invention is that the effective waste ink collection capacity of an ink jet printer is increased without increasing the printer size, such as for example, without increasing the printer height.

Another advantage of the present invention is that the effective waste ink collection capacity of an ink jet printer is increased without requiring placement of ink droplets generated during a spit operation on a printed page.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
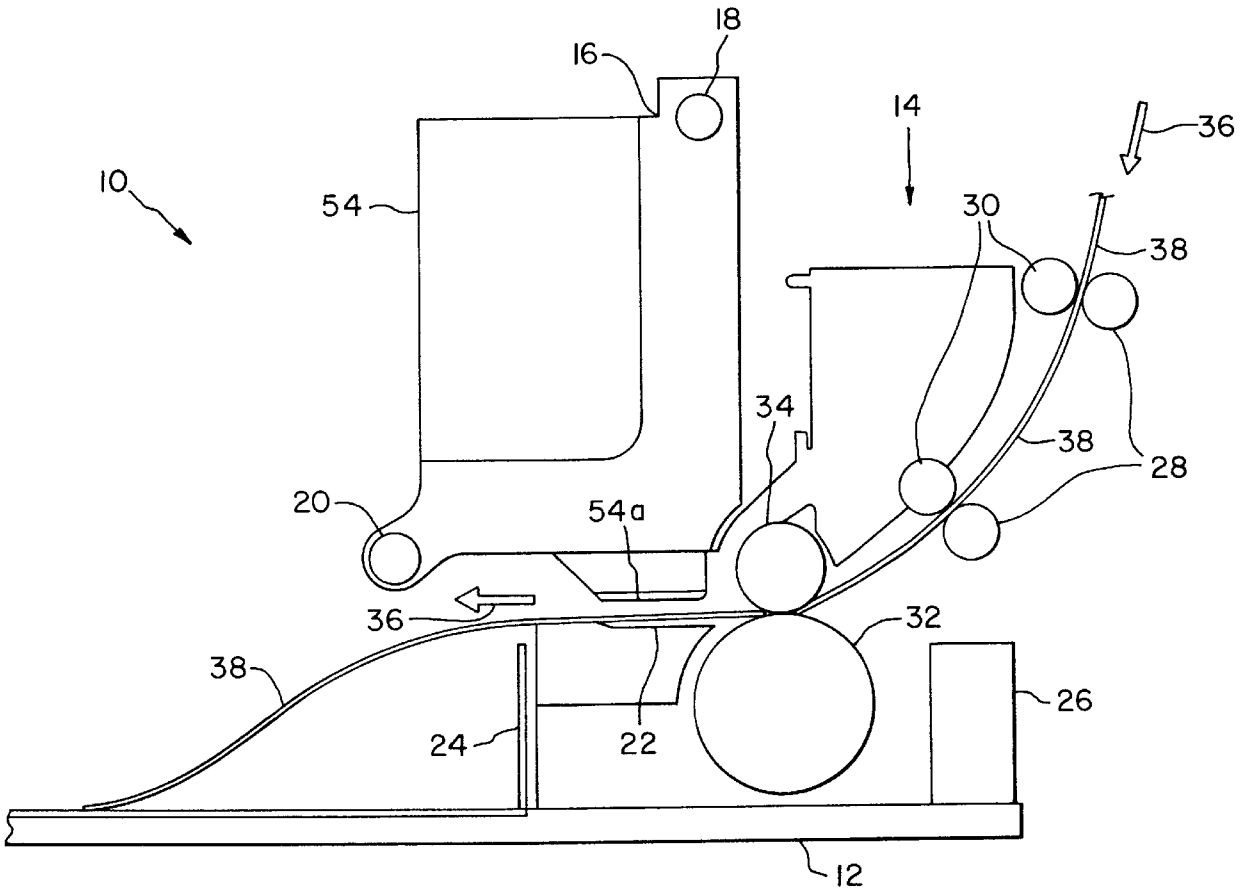
FIG. 1 is a diagrammatic representation of an ink jet printer embodying the present invention.

Referring now to the drawings and particularly to FIG. 1, there is shown an ink jet printer 10 including a frame 12, a media transport assembly 14, a printhead carrier assembly 16, a pair a carrier guide rods 18 and 20, a platen 22, an exit tray 24 and a controller 26.

Media transport assembly 14 is coupled to frame 12, and includes a plurality of driven transport rollers 28 with a corresponding plurality of backup rollers 30, a driven index roller assembly 32, and a pinch roller assembly 34. As more clearly shown in FIG. 2, index roller assembly 32 includes a plurality if index rollers 33 which are located in spaced relation along the width of platen 22. Media transport assembly 14, platen 22 and exit tray 24 define a portion of a media path, depicted by arrows 36, through which a sheet of print media 38 is transported. As shown in FIG. 1, the sheet of print media 38 is shown being transported by media transport assembly 14 over platen 22.

Figure 2:
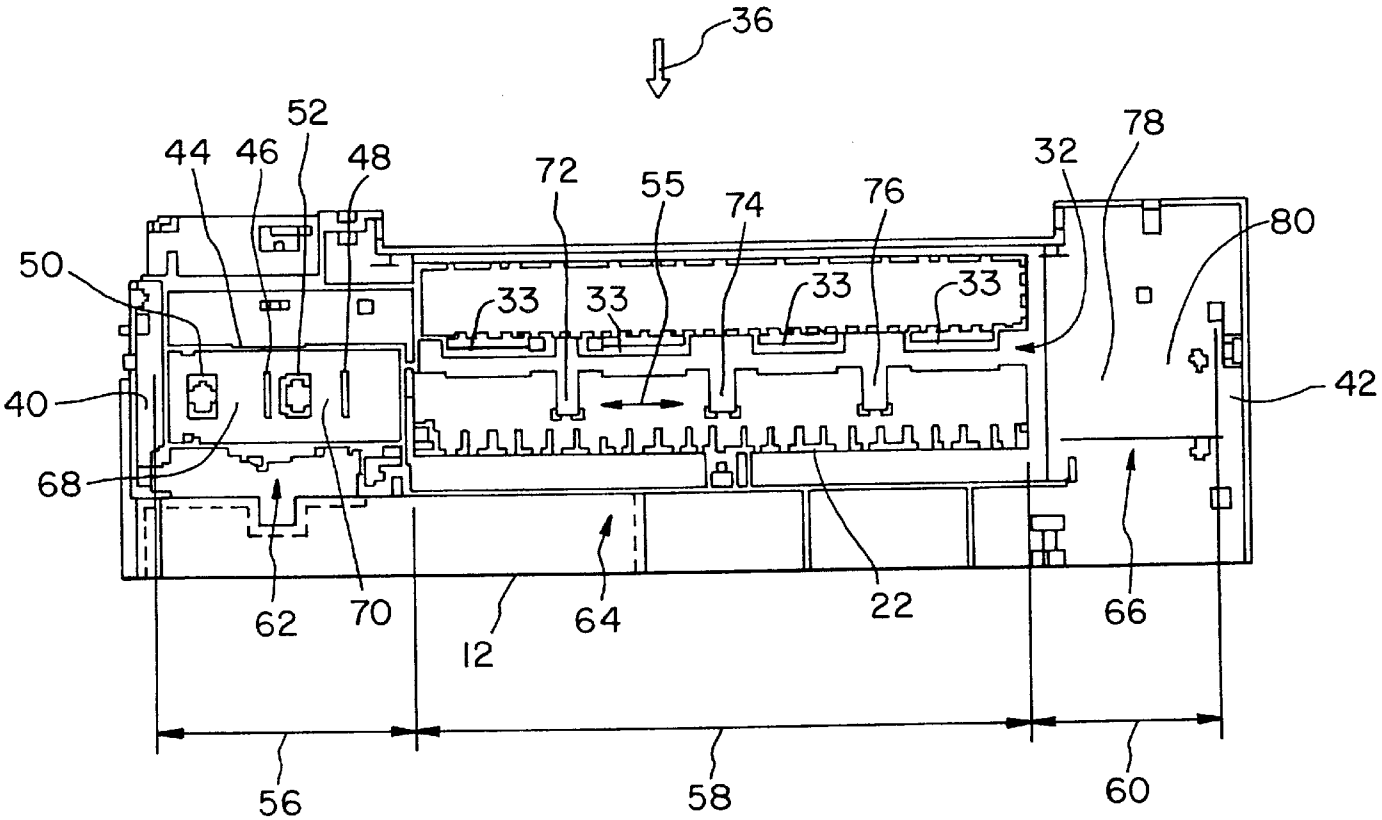
FIG. 2 is a top view of a frame assembly of the ink jet printer of FIG. 1 that shows multiple ink spit areas located along the carrier path.

Referring to FIG. 2, frame 12 includes a first frame portion 40 and a second frame portion 42. Platen 22 extends between first frame portion 40 and second frame portion 42. A maintenance station 44 is coupled to first frame portion 40. Maintenance station 44 includes printhead wipers 46 and 48, and includes printhead caps 50 and 52.

Printhead carrier assembly 16 is adapted to mount at least one printhead cartridge 54 having a corresponding at least one printhead 54*a*. For convenience, element 54 is intended to represent a single printhead cartridge in a single printhead cartridge system, and alternatively, multiple printhead cartridges, e.g., a monochrome cartridge and/or a color cartridge, in a multiple printhead cartridge system. Likewise, element 54*a* is intended to represent a single printhead in a single printhead system, and alternatively, multiple printheads, e.g., a monochrome printhead and/or a color printhead, in a multiple printhead system. Those skilled in the art will recognize that printhead 54*a* may be mounted remotely from cartridge 54, and fluidly coupled to cartridge 54 via a fluid delivery conduit. Printhead carrier assembly 16 is coupled to vertical extensions (not shown) of frame 12 via carrier guide rods 18, 20. Referring to FIGS. 1 and 2, carrier guide rod 18 and carrier guide rod 20 are arranged in parallel, and facilitate reciprocating movement of printhead carrier assembly 16 along a carrier guide path, represented by a double-headed arrow 55, that extends substantially the entire width of frame 12 over first frame portion 40, platen 22 and second frame portion 42.

As shown in FIG. 2, carrier guide path 55 is segmented into three zones: a maintenance zone 56, a print zone 58 and an extension zone 60. Maintenance zone 56 corresponds generally to the width of maintenance station 44. Print zone 58 corresponds generally to the width of platen 22. Extension zone 60 corresponds generally to the width of second frame portion 42. In accordance with the present invention, a first ink spit area 62 is defined in maintenance zone 56, a second ink spit area 64 is defined in print zone 58 and a third ink spit area 66 is defined in extension zone 60.

In the embodiment of the invention shown in FIG. 2, each ink spit area 62, 64 and 66 includes multiple ink spit locations. However, those skilled in the art will recognize the actual number of ink spit locations in each ink spit area 62, 64 and 66 will be dependent, at least in part, on the physical space available for accommodating spitting and could include one or more ink spit locations. As shown, ink spit area 62 includes ink spit locations 68 and 70; ink spit area 64 includes ink spit locations 72, 74 and 76; and ink spit area 66 includes ink spit locations 78 and 80.

Controller 26 is coupled to operatively communicate with media transport assembly 14 and with printhead carrier assembly 16. Controller 26 includes a processor, such as a microprocessor, and associated memory and interface circuitry. Controller 26 executes preprogrammed instructions to controllably advance the sheet of print media 38 in an indexed manner through print zone 58 over platen 22. Controller 26 is coupled to operatively communicate with a carrier drive unit (not shown) for controllably and selectively positioning printhead carrier assembly 16 along carrier guide path 55. The mechanism for detecting the position of printhead carrier assembly 16 along carrier guide path 55 is of a type well known in the art, and can include, for example, a stepper motor drive with a home position sensor, or a DC motor drive and an encoder strip that extends along the length of carrier guide path 55.

Referring to FIG. 2, printhead cap 50, positioned on the left as shown, is used for capping the color printhead of a color printhead cartridge. Printhead cap 52, positioned on the right, is used for capping the monochrome printhead of a monochrome printhead cartridge. First ink spit area 62 is provided at maintenance station 44, and includes ink spit location 68 located in the region just to the right of printhead cap 50, i.e., in the region between printhead cap 50 and printhead wiper 46. First ink spit area 62 also includes ink spit location 70 located in the region just to the right of printhead cap 52, i.e., in the region between printhead cap 52 and printhead wiper 48.

Since the waste ink storage of a dye based ink, such as for example a dye based color ink, is only a function of volume, maintenance station 44 is designed in such a way to provide enough volume for waste dye based ink storage so that the waste dye based ink will not impede the performance of maintenance station 44. Preferably, over time dye based ink will be selectively spit into both of spit locations 68 and 70 of maintenance station 44, such as for example, on an alternating basis. The spit surfaces of spit locations 68 reduce atomization of the dye based ink since the dye based ink readily adheres to the plastic surface of the maintenance station. It is contemplated that one or both of ink spit locations 68 and 70 can be divided into at least two or more independent sub-regions for receiving waste ink. Alternatively, or as a supplemental ink collection device, a porous spit pad can be located at one or both of spit locations 68, 70.

Multiple ink spit locations 72, 74, 76 are located in print zone 58 to provide waste pigment based ink storage so as to receive at least a portion of the pigment based ink ejected during printhead spit maintenance operations. The pigment based ink may be, for example, a pigment based monochrome ink. These locations are located half way between adjacent pairs of the plurality of index rollers 33 so as to reduce the risk of transferring waste pigment based ink to the index rollers 33 and then to the media transported through print zone 58 across platen 22. Since the periphery of each of the plurality of index rollers 33 extends above the surface of platen 22, a determinable amount of waste ink can be accumulated on the surface of platen 22 at each of the three ink spit locations 72, 74 and 76 before the buildup of the accumulated ink solids reach a height that would engage the media transported through print zone 58.

The waste ink accumulation capacity of platen 22 can be increased by recessing at least a portion of the platen surface at ink spit locations 72, 74, 76. Such a recess can be formed, for example, as a waste ink well having a predefined waste ink accumulating volume and depth. It is contemplated that one or more of ink spit locations 72, 74, 76 can be divided into at least two or more independent sub-regions for receiving waste ink. In addition, it is contemplated that one or more of ink spit locations 72, 74, 76 can be formed as a hole in platen 22, thereby permitting waste ink to accumulate on the underlying portion of frame 12. Alternatively, or as a supplemental ink collection device, a porous spit pad can be located at one or more of ink spit locations 72, 74, 76.

As shown in FIG. 2, third ink spit area 66 is defined for location to the right of print zone 58 and at second frame portion 42. This area is also designated for waste pigment based ink storage. It is possible to spit the pigment based ink at many locations in third ink spit area 66, such as for example, at ink spit locations 78 and 80. The waste ink accumulation capacity of second frame portion 42 can be increased by recessing at least a portion of second frame portion 42 at ink spit locations 78, 80. Such a recess can be formed, for example, as a waste ink well having a predefined waste ink accumulating volume and depth. Alternatively, or as a supplemental ink collection device, a porous spit pad can be located at one or both of ink spit locations 78 and 80.

During operation, controller 26 executes preprogrammed instructions to effect both color and monochrome printhead spit maintenance operations. Controller 26 selectively controls an operation of the color printhead during spitting operations to eject a dye based color ink in first ink spit area 62 and selectively controls an operation of the monochrome printhead during spitting operations to eject a pigment based monochrome ink in second ink spit area 64 and/or third ink spit area 66. The term "selectively controls an operation" is meant to include the act of controllably and selectively positioning the printhead requiring spit maintenance over the desired ink spit area and the act of controllably and selectively ejecting ink from the printhead while the printhead is positioned over the desired ink spit area.

In practicing the present invention, it is desired to distribute the waste dye based ink over ink spit locations 68 and 70 of first ink spit area 62, and to distribute the waste pigment based ink over ink spit locations 72, 74, 76, 78 and 80 of ink spit areas 64 and 66. For example, in performing color printhead spit maintenance operations for the embodiment described herein, such a distribution can be achieved by alternating between ink spit locations 68 and 70 for successive dye based ink color printhead spit maintenance operations. In performing monochrome printhead spit maintenance operations, such a distribution can be achieved by sequentially distributing waste pigment based ink in each of ink spit locations 72, 74, 76, 78, 80 for successive monochrome printhead spit maintenance operations.

While the embodiment described herein references the use of a dye based color ink and a pigment based monochrome ink, those skilled in the art will recognize that the invention can be used in a printing system where either, or both, of the monochrome ink and the color ink is pigment based. Thus, variations of the embodiment described herein are possible, so long as each pigment based ink is disposed in the ink spit locations designed to accommodate the height buildup of accumulated waste pigment based ink, such as for example, ink spit locations 72, 74, 76, 78 and/or 80.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for increasing waste ink storage capacity in an ink jet printer, said method comprising the steps of:

providing a printer frame including a first frame portion and a second frame portion;

providing a platen extending between said first frame portion and said second frame portion;

providing a maintenance station coupled to said first frame portion;

providing a printhead carrier for carrying a first printhead and a second printhead, and adapted for reciprocating movement along a carrier path, said carrier path extending over said first frame portion and said platen;

defining a first ink spit area located at said maintenance station;

defining a second ink spit area located at said platen; and selectively controlling an operation of said first printhead during spitting operations to eject a first ink in said first ink spit area and selectively controlling an operation of said second printhead during said sitting operations to eject a second ink in said second ink spit area.

2. The method of claim 1, wherein said first ink spit area comprises at least two ink spit locations.

3. The method of claim 1, wherein said second ink spit area comprises at least two ink spit locations.

4. The method of claim 1, wherein said first ink is a dye based ink and said second ink is a pigment based ink.

5. The method of claim 1, wherein at least one of said first ink and said second ink is a pigment based ink.

6. The method of claim 5, wherein each of said first ink and said second ink is a pigment based ink.

7. The method of claim 1, wherein said carrier path extends over said first frame portion, said platen and said second frame portion.

8. The method of claim 7, further comprising the step of defining a third ink spit area located at said second frame portion.

9. The method of claim 8, wherein said third ink spit area comprises at least two ink spit locations.

10. The method of claim 8, further comprising the step of selectively controlling said operation of said second printhead during said spitting operations to eject said second ink at said third ink spit area.

11. The method of claim 10, wherein said second ink is a monochrome ink.

12. The method of claim 1, wherein said second ink spit area comprises at least one ink collection surface that does not contact a sheet of print media being transported over said platen.

13. The method of claim 1, wherein said second ink spit area comprises at least one of a recessed surface formed in said platen and an opening formed through said platen.

14. A method for increasing waste ink storage capacity in an ink jet printer, said method comprising the steps of:

providing a printer frame including a first frame portion and a second frame portion;

providing a platen extending between said first frame portion and said second frame portion;

providing a maintenance station coupled to said first frame portion;

providing a printhead carrier for carrying a first printhead for ejecting a pigment based ink, and adapted for reciprocating movement along a carrier path, said carrier path extending over said first frame portion, said platen and said second frame portion;

defining a first ink spit area located at said maintenance station;

defining a second ink spit area located at said platen;

defining a third ink spit area located at said second frame portion; and selectively controlling an operation of said first printhead during spitting operations to eject said pigment based ink in at least one of said second ink spit area and said third ink spit area.

15. The method of claim 14, wherein said second ink spit area comprises a plurality of ink spit locations.

16. The method of claim 14, wherein said second ink spit area comprises at least one ink collection surface that does not contact a sheet of print media being transported over said platen.

17. The method of claim 14, wherein said second ink spit area comprises at least one of a recessed surface formed in said platen and an opening formed through said platen.

18. A method for increasing waste ink storage capacity in an ink jet printer, said method comprising the steps of:

providing a printer frame including a first frame portion and a second frame portion:

providing a platen extending between said first frame portion and said second frame portion;

providing a maintenance station coupled to said first frame portion;

providing a printhead carrier for carrying a first printhead for ejecting a pigment based ink, and adapted for reciprocating movement along a carrier path, said carrier path extending over said first frame portion, said platen and said second frame portion;

defining a first ink spit area located at said maintenance station, wherein said first ink spit area comprises a plurality of ink spit locations;

defining a second ink pit area located at said platen;

defining a third ink spit area located at said second frame portion; and selectively controlling an operation of said first printhead during spitting operations to eject said pigment based ink in at least one of said second ink spit area and said third ink spit area.

19. A method for increasing waste ink storage capacity in an ink jet printer, said method comprising the steps of:

providing a printer frame including a first frame portion and a second frame portion;

providing a platen extending between said first frame portion and said second frame portion;

providing a maintenance station coupled to said first frame portion;

providing a printhead carrier for carrying a first printhead for ejecting a pigment based ink, and adapted for reciprocating movement alone a carrier path, said carrier path extending over said first frame portion, said platen and said second frame portion;

defining a first ink spit area located at said maintenance station:

defining a second ink spit area located at said platen;

defining a third ink spit area located at said second frame portion, wherein said third ink spit area comprises a plurality of ink spit locations; and selectively controlling an operation of said first printhead during spitting operations to eject said pigment based ink in at least one of said second ink spit area and said third ink spit area.

20. A method for increasing waste ink storage capacity in an ink jet printer, said method comprising the steps of:

providing a printer frame including a first frame portion and a second frame portion;

providing a platen extending between said first frame portion and said second frame portion;

providing a maintenance station coupled to said first frame portion;

providing a printhead carrier for carrying a first printhead for ejecting a pigment based ink, and adapted for reciprocating movement along a carrier path, said carrier path extending over said first frame portion, said platen and said second frame portion;

defining a first ink spit area located at said maintenance station;

defining a second ink spit area located at said platen;

defining a third ink spit area located at said second frame portion;

selectively controlling an operation of said first printhead during spitting operations to eject said pigment based ink in at least one of said second ink spit area and said third ink spit area; and providing a second printhead for ejecting a dye based ink, and wherein during said spitting operations said dye based ink is spit in said first ink spit area.

21. A method for increasing the waste ink storage capacity in an ink jet printer, said method comprising the steps of:

providing a printer frame including a first frame portion and a second frame portion;

providing a platen extending between said first frame portion and said second frame portion;

providing a maintenance station coupled to said first frame portion; providing a printhead carrier for carrying a first printhead for ejecting a pigment based ink, and adapted for reciprocating movement along a carrier path, said carrier path extending over said first frame portion, said platen and said second frame portion;

defining a first ink spit area located at said maintenance station;

defining a second ink spit area located at said platen;

defining a third ink spit area located at said second frame portion; and selectively controlling an operation of said first printhead during spitting operations to eject said pigment based ink in at least one of said second ink spit area and said third ink spit area, wherein said first printhead is a monochrome printhead and said second printhead is a color printhead, and wherein during said spitting operations a color ink is spit in said first ink spit area and a monochrome ink is spit in each of said second ink spit area and said third ink spit area.

22. A method for increasing waste ink storage capacity in an ink jet printer, said method comprising the steps of:

defining a first ink spit area located outside a print zone of said printer;

defining a second ink pit area located in said print zone of said printer;

defining a third ink spit area located outside said print zone, said print zone being located between said first ink spit area and said third ink spit area; and selectively controlling an operation of a selected one of a plurality of printheads during spitting operations to eject a pigment based ink in a selected one of said first ink spit area, said second ink spit are and said third ink spit area.

23. The method of claim 22, wherein said second ink spit area comprises a plurality of ink spit locations.

24. The method of claim 22, wherein said second ink spit area comprises at least one ink collection surface that does not contact a sheet of print media being transported over said platen.

25. The method of claim 22, wherein said second ink spit area comprises at least one of a recessed surface formed in said platen and an opening formed through said platen.

26. A method for increasing waste ink storage capacity in an ink jet printer, said method comprising the steps of:

defining a first ink spit area located outside a print zone of said printer, wherein said first ink spit area comprises plurality of ink spit locations;

defining a second ink spit area located in said print zone of said printer;

defining a third ink spit area located outside said print zone, said print zone being located between said first ink spit area and said third ink spit area; and selectively controlling an operation of a selected one of a plurality of printheads during spitting operations to eject a pigment based ink in a selected one of said first ink spit area, said second ink spit are and said third ink spit area.

27. A method for increasing waste ink storage capacity in an ink jet printer, said method comprising the steps of:

defining a first ink spit area located outside a print zone of said printer;

defining a second ink spit area located in said print zone of said printer;

defining a third ink spit area located outside said print zone, said print zone being located between said first ink spit area and said third ink spit area, wherein said third ink spit area comprises a plurality of ink spit locations; and selectively controlling an operation of a selected one of a plurality of printheads during spitting operations to eject a pigment based ink in a selected one of said first ink spit area, said second ink spit are and said third ink spit area.

28. A method for increasing waste ink storage capacity in an ink jet printer, said method comprising the steps of:

defining a first ink spit area located outside a print zone of said printer;

defining a second ink spit area located in said print zone of said printer;

defining a third ink spit area located outside said print zone, said print zone being located between said first ink spit area and said third ink spit area; and selectively controlling an operation of a selected one of a plurality of printheads during spitting operations to eject ink in a selected one of said first ink spit area, said second ink spit area and said third ink spit area;

wherein said selected one of said plurality of printheads contains at least one of a color ink and a monochrome ink, each of said color ink and said monochrome ink being one of a dye based ink and a pigment based ink, and wherein during said spitting operations each said dye based ink is spit in said first ink spit area and each said pigment based ink is spit in at least one of said second ink spit area and said third ink spit area.

29. A method for increasing waste ink storage capacity in an ink jet printer, said method comprising the steps of:

defining a first ink spit area located outside a print zone of said printer;

defining a second ink spit area located in said print zone of said printer;

defining a third ink spit area located outside said print zone, said print zone being located between said first ink spit area and said third ink spit area; and selectively controlling an operation of a selected one of a plurality of printheads during spitting operations to eject ink in a selected one of said first ink spit area, said second ink spit area and said third ink spit area, wherein said selected one of said plurality of printheads contains at least one of a color ink and a monochrome ink, and wherein during said spitting operations said color ink is spit in said first ink spit area, and aid monochrome ink is spit in each of said second ink spit area and said third ink spit area.

30. A method for increasing waste ink storage capacity in an ink jet printer, said method comprising the steps of:

providing a printer frame including a first frame portion and a second frame portion;

providing a platen extending between said first frame portion and said second frame portion;

providing a maintenance station coupled to said first frame portion;

providing a printhead carrier for carrying a printhead, and adapted for reciprocating movement along a carrier path, said carrier path extending over said first frame portion, said platen and said second frame portion;

defining an ink spit a located at one of said platen and said second frame portion; and selectively controlling an operation of said printhead during spitting operations to eject a pigment based ink in said ink spit area.

31. The method of claim 30, wherein said ink spit area comprises a plurality of ink spit locations.

* * * * *